United States Patent [19]

Ferguson

[11] 4,021,087

[45] May 3, 1977

[54] MULTIPLE INTERLOCKING PANEL DESK

[76] Inventor: James S. Ferguson, 10111 N. Western, Oklahoma City, Okla. 73114

[22] Filed: Nov. 13, 1975

[21] Appl. No.: 631,639

[52] U.S. Cl. ..... 312/195; 312/140.2; 312/263

[51] Int. Cl.[2] ..... A47B 17/00

[58] Field of Search ..... 312/140.2, 194, 195, 312/245, 257 R, 257 SK, 257 M, 263, 129; 108/131

[56] References Cited

UNITED STATES PATENTS

| | | | |
|---|---|---|---|
| 993,237 | 5/1911 | Fritts et al. | 312/140.3 |
| 1,734,651 | 11/1929 | Stickley | 312/263 |
| 1,833,081 | 11/1931 | Kilmer | 312/257 R |
| 2,801,895 | 8/1957 | Gass | 312/257 SK |
| 3,287,078 | 11/1966 | Lew | 312/263 |
| 3,379,483 | 4/1968 | Oldford | 312/263 |
| 3,838,902 | 10/1974 | Tenani | 312/195 |

*Primary Examiner*—Casmir A. Nunberg
*Attorney, Agent, or Firm*—William R. Laney

[57] ABSTRACT

An improved desk structure comprising multiple interlocking panels. The structure includes a pair of parallel vertical end panels interconnected by a pair of parallel transverse vertical panels by dovetail tongue and groove joints. First and second horizontal transverse panels are secured between the vertical end panels by tongue and groove joints and extend respectively outwardly from one of the vertical transverse panels. A pair of spaced parallel vertical intermediate panels extend upwardly from one of the horizontal transverse panels and are connected to one of the vertical transverse panels by tongue and groove joints. A rigid horizontal top panel is supported by the upper edges of the end panels, the transverse vertical panels and the spaced parallel intermediate panels. The top panel is preferably formed of rigid transparent material.

5 Claims, 4 Drawing Figures

MULTIPLE INTERLOCKING PANEL DESK

BACKGROUND OF THE INVENTION

1. Field of the Invention

This invention relates generally to improvements in furniture construction, and more particularly, but not by way of limitation, to a multiple interlocking panel furniture structure.

2. Description of the Prior Art

The prior art contains a number of teachings of articles of furniture, generally known as knock-down furniture, of the type which might be regarded as do-it-yourself furniture with regard to the assembly process. Such furniture, however, generally necessitates the use of nails or screws to complete the assembly of the furniture unit. Other forms of knock-down furniture employ multiple panels which slip together with interlocking notches in order to provide what is claimed to be a rigid structure without the use of any tools or hardware.

SUMMARY OF THE INVENTION

The present invention contemplates an article of furniture which includes first and second spaced parallel vertical end panels having mutually facing inner surfaces and coplanar upper edges, therefor. A transverse vertical panel is further included which has a dovetail tongue formed on each end thereof and received respectively in corresponding dovetail grooves formed in the inner surfaces of the first and second end panels. A rigid, planar top panel extends between and is supported by the coplanar upper edges therefor of the first and second end panels.

An object of the invention is to provide an article of furniture which may be easily assembled from the various parts or elements thereof.

Another object of the invention is to provide an article of furniture which can be readily assembled without the use of tools or hardware.

A further object of the invention is to provide an article of furniture which is economical to transport from the manufacturer to the ultimate user.

A still further object of the invention is to provide an article of furniture in the form of a multiple interlocking panel desk which is economical to construct, inexpensive to ship and simple to assemble.

Other objects and advantages of the invention will be evident from the following detailed description when read in conjunction with the accompanying drawing.

DESCRIPTION OF A PREFERRED EMBODIMENT

Figure 1:
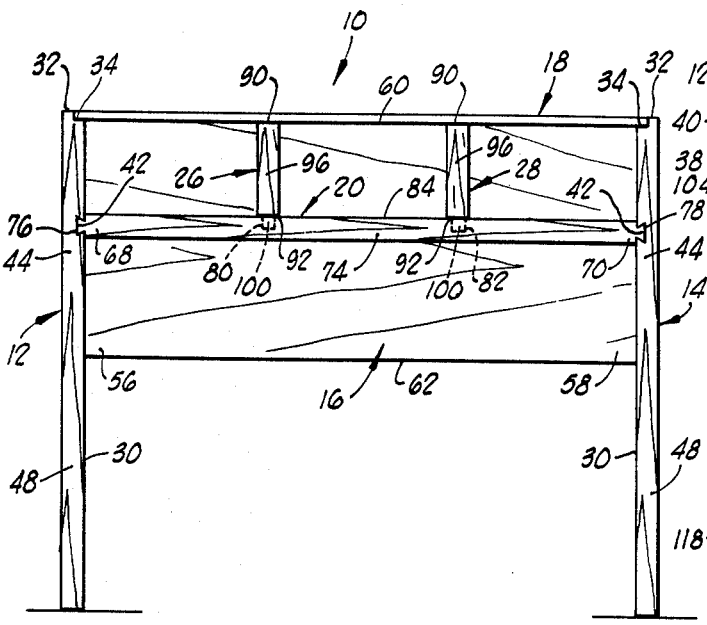
FIG. 1 is a front elevation view of a multiple interlocking panel desk constructed in accordance with the present invention.
Figure 3:
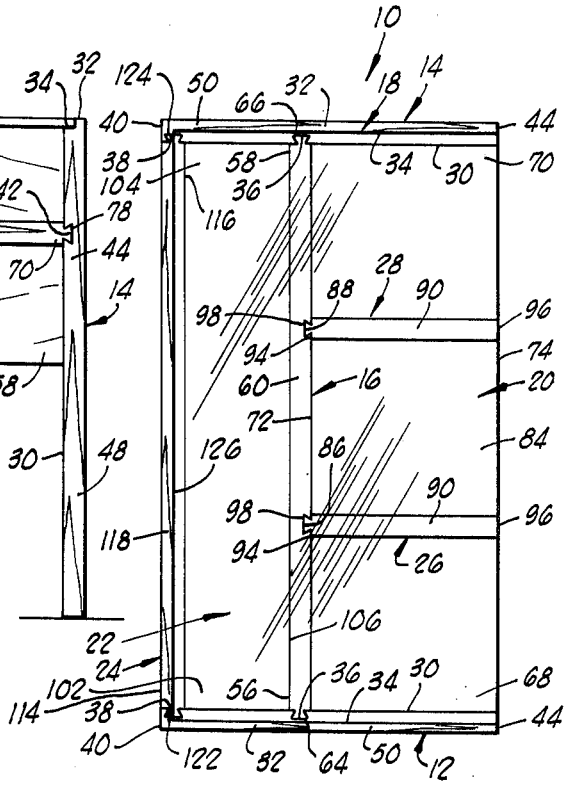
FIG. 3 is a top plan view of the desk in FIG. 1.
Figure 2:
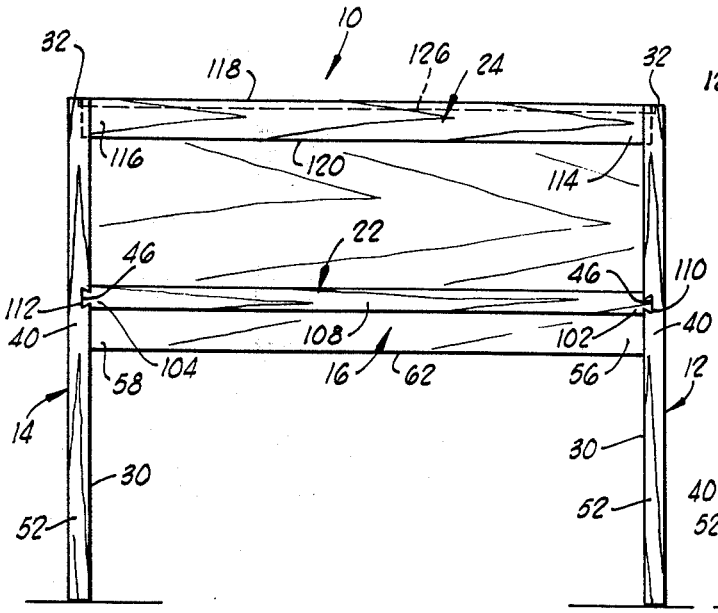
FIG. 2 is a rear elevation view of the desk of FIG. 1.
Figure 4:
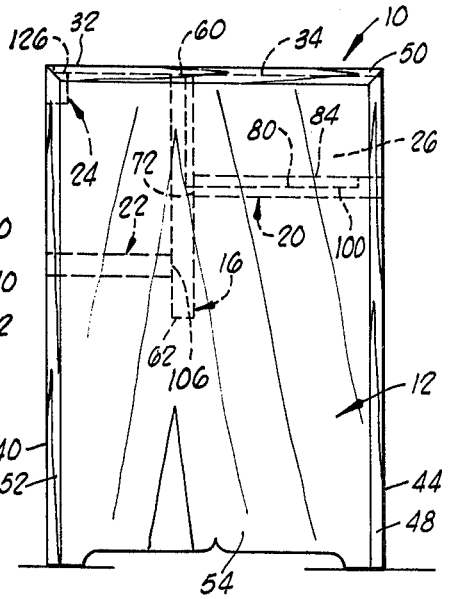
FIG. 4 is a side elevation view of the desk of FIG. 1.

Referring now to the drawing, the article of furniture or desk of the present invention is generally designated by the reference character 10. The article of furniture 10 is in the form of a desk comprising multiple interlocking panels. The desk 10 includes first and second horizontally spaced, parallel vertical end panels 12 and 14, a first transverse vertical panel 16, a planar, horizontal top panel 18, a first transversely extending, therefor horizontal panel 20, a second transverse horizontal panel 22, a second transverse vertical panel 24, and a pair of horizontally spaced, vertical intermediate panels 26 and 28.

The first and second vertical end panels 12 and 14 are substantially identical in construction except that the first end panel 12 is the opposite hand or mirror image of the second end panel 14. The end panels 12 and 14 include mutually facing inner surfaces 30 and substantially coplanar upper and lower edges or surfaces 32 and 33. The upper edges or surfaces 32 of each of the end panels 12 and 14 each include a recess 34 formed therein communicating with the inner surface 30.

A first vertically downwardly extending dovetail groove 36 is formed in the inner surface 30 of each end panel 12 and 14 and communicates with the respective upper surface 32 thereof. Each end panel 12 and 14 further includes a second vertically downwardly extending dovetail groove 38 formed in the inner surface 30 thereof adjacent the coplanar rear edge 40 of the end panel and also communicating with the respective upper surface 32 thereof.

Each end panel 12 and 14 further includes a first horizontal dovetail groove 42 formed in the inner surface 30 thereof and communicating between the vertical dovetail groove 36 and the opposite coplanar front edge 44 of the respective end panel. A second horizontal dovetail groove 46 is formed in the inner surface 30 of each end panel 12 and 14 and communicates between the vertical dovetail groove 36 and the vertical edge 40 of the respective end panel.

Each end panel 12 and 14 may further include edge moldings 48, 50 and 52, suitable secured, as by gluing, to the central portion 54 of each end panel along the opposite vertical edge 44, the upper surface or edge 32 and the vertical edge 40, respectively, to form a unitary end panel structure.

The first transverse vertical panel 16 includes first and second vertical end portions 56 and 58 interconnected by a horizontal top surface or edge 60 side edges 61 and a horizontal bottom surface or edge 62. A first vertical dovetail tongue 64 is formed on the first end portion 56 and a second vertical dovetail tongue 66 is formed on the second end portion 58 of the first transverse vertical panel 16. The first dovetail tongue 64 is slidingly, interlockingly engaged within the vertical dovetail groove 36 of the first end panel 12 while the second dovetail tongue 66 is slidingly, interlockingly engaged within the vertical dovetail groove 36 of the second end panel 14. It will be understood that the vertical depth and the vertical length of the dovetail grooves 36 and the dovetail tongues 64 and 66 are selected so that the upper surface 60 of the first transverse vertical panel 16 is coplanar with the recesses 34 of the upper surfaces 32 of the end panels 12 and 14 when the first transverse vertical panel is fully engaged with the first and second end panels, as most clearly shown in FIG. 1.

The first transverse horizontal panel 20 includes a first end portion 68, a second end portion 70 and rear edges or surfaces 72, a pair of opposed, parallel side edges or surfaces 73 and front edges or surfaces 74 extending between the first and second end portions 68 and 70. A first horizontal dovetail tongue 76 is formed on the first end portion 68, and a second horizontal dovetail tongue 78 is formed on the second end portion 70 of the horizontal panel 20. The dovetail tongues 76 and 78 are slidingly, interlockingly received within the first horizontal grooves 42 of the first and second end panels 12 and 14, respectively. When fully engaged with the first and second end panels 12 and 14, the rear edge or surface 72 of the horizontal panel 20 abuts one side of the first transverse vertical panel 16 and the front edge or surface 74 of the horizontal panel 20 is preferably coplanar with the front vertical edges 44 of the first and second end panels 12 and 14 forming a first horizontal storage compartment shelf.

A pair of parallel grooves 80 and 82 are formed in the upper surface 84 of the first transverse horizontal panel 20 and intersect a pair of parallel vertical dovetail grooves 86 and 88 formed in the adjacent side of the first transverse vertical panel 16 and extending upwardly from the horizontal panel 20 to respective intersections with the horizontal upper surface 60 of the transverse vertical panel 16.

The vertical intermediate panels 26 and 28 are identical in construction and each includes a horizontal upper edge or surface 90, a horizontal lower edge or surface 92 and vertical inner and outer surfaces 94 and 96 interconnecting the upper and lower edges or surfaces. A vertical dovetail tongue 98 is formed on each vertical inner surface 94 and a downwardly extending horizontal tongue 100 is formed along each horizontal lower surface 92 of the intermediate panels 26 and 28. The dovetail tongues 98 are slidingly, interlockingly engaged within the dovetail grooves 86 and 88 of the first transverse vertical panel 16 and the horizontal tongues 100 are received within the parallel grooves 80 and 82 of the first transverse horizontal panel 20. When properly installed, the upper surfaces 90 of the intermediate panels 26 and 28 are coplanar with the upper surface 60 of the first transverse vertical panel 16 and the recesses 34 of the upper surfaces 32 of the first and second end panels 12 and 14. Also, the vertical outer surfaces 96 of the intermediate panels 26 and 28 are preferably coplanar with the vertical edges 44 of the first and second end panels and the outer surface 74 of the first transverse horizontal panel 20. Installation of the intermediate panels 26 and 28 produces subcompartments within the space defined by the end panels 12 and 14, the first transverse vertical panel 16, the top panel 18 and the first transverse horizontal panel 20.

The second transverse horizontal panel 22 includes a first end portion 102, a second end portion 104 and parallel a rear edge 106, two side edges 107 and a front edge 108 extending between the first and second end portions. First and second horizontal dovetail tongues 110 and 112 are formed respectively on the first and second end portions 102 and 104 and are slidingly, interlockingly received within the second horizontal dovetail grooves 46 of the first and second end panels 12 and 14, respectively. When properly installed, the inner edge 106 of the second transverse horizontal panel 22 abuts the adjacent side of the first transverse vertical panel 16, and the outer surface or edge 108 of the horizontal panel 22 is preferably coplanar with the vertical edges 40 of the first and second end panels 12 and 14 forming a second horizontal storage compartment shelf.

The second transverse vertical panel 24 includes first and second end portions 114 and 116, and upper and lower horizontal surfaces or edges 118 and 120 extending between the first and second end portions 114 and 116. First and second vertical dovetail tongues 122 and 124 are formed respectively on the first and second end portions 114 and 116 and are slidingly, interlockingly received in the vertical dovetail grooves 38 of the first and second end panels 12 and 14, respectively. A recess 126 extends along the inner portion of the upper horizontal surface 118, forming a part thereof, and is coplanar with the recesses 34 of the upper surfaces 32 of the first and second end panels 12 and 14. It will be understood that the dovetail grooves 38 and the dovetail tongues 122 and 124 are suitably configured so that the upper horizontal surface 118 of the second transverse vertical panel 24 is coplanar with the upper surfaces 32 of the first and second end panels 12 and 14, and the recesses 126 and 34, associated with these upper surfaces, are also coplanar.

The planar, horizontal top panel 18 is preferably formed of a rigid, transparent material, such as glass, plexiglass or other suitable synthetic resinous material, and is rectangular in shape. The top panel 18 is sized and shaped to snugly fit within the recesses 126 and 34 of the vertical panel 24 and the first and second end panels 12 and 14, and is supported thereby as well as by the upper surface 60 of the first transverse vertical panel 16 and the upper surfaces 90 of the vertical intermediate panels 26 and 28.

All of the elements of the desk 10, with the exception of the top panel 18, are preferably constructed of panels formed of solid wood, plywood, or suitably veneered particle board as may be desired.

The desk 10 may be advantageously shipped in a knocked down or dismantled condition for convenient and quick assembly at the location of the ultimate user. To assemble the desk 10, the first and second end panels 12 and 14 are vertically positioned with their inner surfaces 30 facing each other. The first transverse vertical panel 16 is then secured to the first and second end panels by slidingly engaging the dovetail tongues 64 and 66 thereof within the dovetail grooves 36 of the end panels 12 and 14.

The second transverse vertical panel 24 is then secured to the first and second end panels by slidingly engaging the dovetail tongues 122 and 124 thereof in the dovetail grooves 38 of the first and second end panels 12 and 14. The first transverse horizontal panel 20 is then installed by slidingly engaging the dovetail tongues 76 and 78 thereof in the first horizontal dovetail grooves 42 of the first and second end panels 12 and 14 until the rear edge 72 of the horizontal panel 20 abuts the adjacent vertical surface of the first transverse vertical panel 16. The vertical intermediate panels 26 and 28 are then installed by slidingly engaging the dovetail tongues 98 thereof in the parallel dovetail grooves 86 and 88 of the first transverse vertical panel 16 until the horizontal tongues 100 of the intermediate panels 26 and 28 are fully received within the parallel grooves 80 and 82 in the upper surface 84 of the first transverse horizontal panel 20.

The second transverse horizontal panel 22 is then installed by slidingly engaging the dovetail tongues 110 and 112 thereof within the second horizontal dovetail grooves 46 of the first and second end panels 12 and 14 until the rear edge 106 of the horizontal panel 22 abuts the adjacent vertical surface of the first transverse vertical panel 16.

Finally, the planar, horizontal top panel 18 is disposed within the recesses 126 and 34 of the second transverse vertical panel 24 and the first and second end panels 12 and 14 thus completing the assembly of the desk 10.

It will thus be seen that the article of furniture of the present invention provides a desk structure, suitable for use by children, of pleasing appearance, which may be conveniently and inexpensively shipped in knocked down or disassembled condition and quickly assembled at the point of use without recourse to tools or hardware of any kind.

Changes may be made in the combination and arrangement of parts or elements as heretofore set forth in the specification and shown in the drawing without departing from the spirit and scope of the invention as defined in the following claims.

What is claimed is:

1. A desk of multiple, detachably interlocking panels having top-accessible storage compartments, and having unobstructed leg and knee space comprising:

first and second horizontally spaced, parallel vertical end panels having mutually facing inner surfaces and coplanar lower edges, coplanar upper edges, coplanar front edges and coplanar rear edges, said vertical panels each further having a dovetail groove extending vertically downwardly from the upper edge thereof and opening in said inner surface, said vertically downwardly extending dovetail grooves each being positioned intermediate said front and rear edges of the respective end panel, and spaced from the front and rear edges of the respective end panel in which the respective dovetail groove is located, said vertical end panels further having a first pair of parallel, horizontally extending dovetail grooves projecting from the front edges of said vertical end panels inwardly to said first-mentioned dovetail grooves, and projecting perpendicular to said first-mentioned dovetail grooves, and said vertical end panels having a second pair of parallel, horizontally extending dovetail grooves projecting inwardly from the back edges of said end panels to said first-mentioned dovetail grooves and extending perpendicular to said first-mentioned dovetail grooves;

a first transverse vertical panel extending between said end panels in a plane substantially normal to the mutually facing inner surfaces of said end panels, and positioned intermediate said front and rear edges of said vertical end panels, said first transverse vertical panel having side edges, a top edge and a bottom edge and further including a dovetail tongue formed on each of said side edges thereof, each of said dovetail tongues on said transverse vertical panel extending into, and slidably received by, one of said dovetail grooves in the inner surface of one of said vertical end panels, whereby said first transverse vertical panel can be slidably inserted in the dovetail grooves in said first and second vertical end panels by insertion in the grooves from above, followed by downward sliding movement, the bottom edge of said first transverse vertical panel being spaced upwardly from the lower edges of said first and second vertical end panels to afford leg space below said first transverse vertical panel, said first transverse vertical panel and said dovetail grooves in said end panels having a common dimension such that the top edge of said first transverse vertical panel terminates in substantially the same plane as the coplanar upper edges of said first and second vertical end panels;

a first transversely extending horizontal panel projecting in a horizontal plane between said end panels and disposed on one side of said first transverse vertical panel, said first transverse horizontal panel having a front edge, a rear edge and a pair of opposed, parallel side edges, said first transverse horizontal panel further including a dovetail tongue on each of said side edges extending into and slidingly received by said first pair of parallel, horizontally extending dovetail grooves in said vertical end panels to slidingly support said first transverse horizontal panel in the dovetail grooves in said end panels, said first transverse horizontal panel having its rear edge abutting said first transverse vertical panel and forming with said end panels and said first transverse vertical panel a first storage compartment and constituting a horizontal storage compartment shelf in said desk spaced downwardly from the upper edges of said parallel vertical end panels and above the bottom edge of said first transverse vertical panel;

a second transverse horizontal panel extending between said end panels in a horizontal plane and including a front edge, a rear edge and two side edges, said second transverse horizontal panel having dovetail tongues on each of said side edges extending into and slidably received by said second pair of horizontally extending dovetail grooves in the inner surfaces of said first and second end panels whereby said second horizontal panel can be slidably inserted between and removed from said vertical end panels, said second transverse horizontal panel forming with said end panels and said first transverse vertical panel a second storage compartment and constituting a second horizontal storage compartment shelf in said desk positioned on the opposite side of said transverse vertical panel from said first transverse horizontal panel, said second transverse horizontal panel having its front edge abutting said first transverse vertical panel;

said first and second transverse horizontal panels, conjunctively with said first transverse vertical panel, fixing the spacing between said end panels, and said first and second transverse horizontal panels preventing canting and pivoting of said end panels about the line of interlock of said end panels with said first transverse vertical panel where the dovetail tongues of said vertical panels detachably interlock with the vertically extending dovetail grooves in the inner surfaces of said first and second end panels; and a top panel having side edges and extending between the end panels and removably supported by the upper edges of said end panels and the top edge of said first transverse vertical panel to provide a top for said desk and a closure at the upper side of the storage compartments formed by the cooperation of said top panel and said first and second horizontal panels with said first transverse vertical panel.

2. A desk as defined in claim 1 and further characterized as including a plurality of intermediate vertical panels horizontally spaced from each other and said end walls, said intermediate vertical panels resting upon said first transverse horizontal panel, partially supporting said top panel and detachably engaged along one vertical edge therof with said first transverse vertical panel to selectively partition the first storage compartment over said first transverse horizontal panel into a plurality of subcompartments.

3. A desk as defined in claim 1 wherein each of said top edges of each of said end panels is recessed to removably receive side edges of said top panel, and to permit said top panel to be moved in a horizontal direction while supported in the recesses in said top edges or, alternatively, to be lifted vertically off said end panels to open said storage compartments from above; and where said desk is further characterized as including panel means adjacent said rear and upper edges of said end panels to stop the horizontal movement of said top panel in one direction when said top panel covers said storage compartments.

4. A desk as defined in claim 3 and further characterized as including a second vertically downwardly extending dovetail groove in each of said end panels, and wherein said panel means is a second transverse vertical panel extending between said end panels in a plane substantially parallel to said first transverse vertical panel, said second transverse vertical panel having upper and lower horizontal edges and first and second end portions, said second transverse vertical panel further including a dovetail tongue formed on each of said end portions thereof, each of said dovetail tongues extending into, and slidably received by, one of said second vertically downwardly extending dovetail grooves in said first and second vertical end panels by insertion in the grooves from above, followed by downward sliding movement, the lower edge of said second transverse vertical panel being spaced upwardly from said second transverse horizontal panel to provide horizontal access to the storage compartment formed by the cooperation of said top panel, second horizontal panel and first transverse vertical panel, said second transverse vertical panel and said dovetail grooves in said end panels having a common dimension such that the upper edge of said second transverse vertical panel terminates in substantially the same plane as the coplanar upper edges of said first and second end panels, said upper horizontal edge of said second transverse vertical panel including a recess coplanar with the recesses in the upper edges of the first and second vertical end panels.

5. A desk as defined in claim 1 wherein all of said panels are flat, substantially monoplanar panels, and each of said panels is manually detachable from all other panels with which it is in contact, whereby said desk can be assembled and disassembled quickly and manually and, in the disassembled form, can be compactly arranged by superimposition of the several panels in flatly abutting, superimposed relation to each other in which the planes of the panels extend parallel to each other.

* * * * *

UNITED STATES PATENT OFFICE

CERTIFICATE OF CORRECTION

Patent No. 4,021,087 Dated May 3, 1977

Inventor(s) James S. Ferguson

It is certified that error appears in the above-identified patent and that said Letters Patent are hereby corrected as shown below:

Column 1, line 26, delete "therefor".

Column 1, line 32, delete "therefor".

Column 1, line 68, delete "therefor".

Column 3, line 21, after "outer" add the words

--edges or--.

Column 3, line 22, delete "edges or".

Signed and Sealed this twelfth Day of July 1977

[SEAL]

Attest:

RUTH C. MASON
Attesting Officer

C. MARSHALL DANN
Commissioner of Patents and Trademarks